United States Patent [19]

Zanardi

[11] Patent Number: 4,662,504

[45] Date of Patent: May 5, 1987

[54] APPARATUS FOR ARRANGING ARTICLES INTO GROUPS

[75] Inventor: Giancarlo Zanardi, Lazzaro di Savena, Italy

[73] Assignee: Azionaria Costruzioni Macchine Automatiche-A.C.M.A.-S.p.A., Italy

[21] Appl. No.: 730,924

[22] Filed: May 6, 1985

[30] Foreign Application Priority Data

May 9, 1984 [IT] Italy ..... 3457 A/84

[51] Int. Cl.[4] ..... B65G 47/52

[52] U.S. Cl. ..... 198/429; 198/424; 198/425; 414/49; 53/542

[58] Field of Search ..... 198/424–426, 198/429, 430, 468.8, 416, 417, 751, 786; 414/48, 49, 80; 53/532, 542

[56] References Cited

U.S. PATENT DOCUMENTS

| | | | |
|---|---|---|---|
| 3,127,029 | 3/1964 | Luginbuhl | 198/425 X |
| 3,278,047 | 10/1966 | Miller | 414/80 X |
| 3,525,097 | 8/1970 | Maulini | 198/429 |
| 4,098,392 | 7/1978 | Greene | 198/425 |
| 4,374,559 | 2/1983 | Morton | 198/424 X |

FOREIGN PATENT DOCUMENTS

| | | | |
|---|---|---|---|
| 0077508 | 4/1983 | European Pat. Off. | 53/542 |
| 1167254 | 4/1964 | Fed. Rep. of Germany | 53/542 |
| 1250337 | 9/1967 | Fed. Rep. of Germany | 198/426 |

*Primary Examiner*—Robert J. Spar
*Assistant Examiner*—Lyle Kimms
*Attorney, Agent, or Firm*—A. N. McCartney

[57] ABSTRACT

Apparatus for separating articles supplied by a plurality of supply lines, into a plurality of groups and supplying these to a receiving line comprises a plurality of clamping devices at the outlet of the supply lines arranged to clamp the articles, a plurality of support elements arranged as a continuation of the supply lines lower than the outlets removable to release the groups, a plurality of faces reciprocatable between the outlets and an end position which reach the end position after the clamping devices have closed and are returned to the outlet on re-opening of the devices, a plurality of carriers movable between a raised position, immediately beneath the support elements and overlying the receiving line, and a lowered position beneath the line, arranged in their raised position, to receive groups of articles released by the support elements and to release them in their turn into the receiving line.

8 Claims, 4 Drawing Figures

B
5

APPARATUS FOR ARRANGING ARTICLES INTO GROUPS

FIELD OF THE INVENTION

The present invention is concerned with apparatus for arranging articles in groups, especially articles which are standing on edge and leaning against one another, for example biscuits, delivered by a plurality of supply lines. Such apparatus is designed to separate the articles arriving progressively from the supply lines into respective groups and to supply these groups to a receiving line, which transfers them to subsequent processing stages such as wrapping and boxing.

BACKGROUND OF THE INVENTION

In the industrial manufacture and packaging of biscuits, the biscuits leave the cooking oven in a continuous flow, along a plurality of lines and lying flat. For some types of biscuit and packaging it has already been proposed that, travelling along the supply line, the biscuits are stood on edge and abutted against one another. It is then necessary to pick up from the delivery lines appropriate groups either consisting of a predetermined number of biscuits or having, in total, a predetermined length.

Apparatus which is already available for the formation for such groups and their transfer to the receiving lines are subject to considerable difficulties and inconveniences. In fact the solutions which have been resorted to in such known apparatus in order to vary the number of supply lines, provide for temporary shutdowns or malfunctions of some of the lines, cope with variations in the thickness of biscuits in the course of production, or variation of capacity on the supply lines, have been very complex and unwieldy. Furthermore existing equipment, because of its construction and so as not to cause breakages of fragile articles such as biscuits, operates at low speed or takes up too much space.

OBJECTS OF THE INVENTION

An object of the present invention is therefore to provide improved apparatus which is suitable for separating articles delivered standing on edge by supply lines into groups and to supply these groups to a receiving line.

SUMMARY OF THE INVENTION

The above and other objects are achieved, according to the invention by apparatus for separating articles leaning against each other standing on edge supplied by a plurality of supply lines into a plurality of groups and supplying them to a receiving line which comprises a plurality of clamping devices disposed at the outlets of these supply lines and so constructed and arranged as to close simultaneously in the operation of the apparatus to clamp the above mentioned articles, a plurality of support elements disposed as a continuation of the supply lines at a lower level than said outlets and so constructed and arranged to be simultaneously removed to release the groups of articles, a plurality of faces mounted for movement simultaneously in a reciprocating manner between the outlet of the respective supply lines and a remote, end portion which is spaced from the outlet by a distance which is slightly greater than the length of each individual group of article, and so constructed and arranged as to reach the end position after the closure of the clamping devices and on the return stroke to reach this outlet substantially on reopening of said devices, a plurality of carriers movable simultaneously alternately between a raised position, immediately beneath the associated support elements above said receiving line, and a lowered position beneath the receiving line and arranged, in the raised position, to receive the groups of articles released by the support elements and to release them in their turn into the receiving line which the carriers intersect, the receiving line being arranged to be stationary during the movement of said carriers and, between the release onto the receiving line of one set of groups of articles and the release of a subsequent set, being arranged to advance by as many steps as there are supply lines, in a direction transverse to the supply lines.

Apparatus according to the invention also preferably comprises a plurality of sprung fingers which are movable simultaneously in register with, the outlets and which, on the closure of said clamping devices are arranged to act upstream of the groups of articles in such a way as to cause, as the respective movable faces reach the end position, a clear separation between the last article of each of the groups and the corresponding article clamped by the clamping devices, the fingers being furthermore arranged to remain in contact with said article thus temporarily clamped until, on re-opening of the clamping device, the movable faces return to these outlets and themselves provide the contact.

BRIEF DESCRIPTION OF THE DRAWINGS

There now follows a detailed description, to be read with reference to the accompanying drawings, of apparatus embodying the invention. It will be realised that this apparatus has been selected for description to illustrate the invention by way of example and not of limitation of the invention and that the invention may reside in any novel aspect of the apparatus.

In the accompanying drawings.

DESCRIPTION OF THE PREFERRED EMBODIMENT

Figure 1:
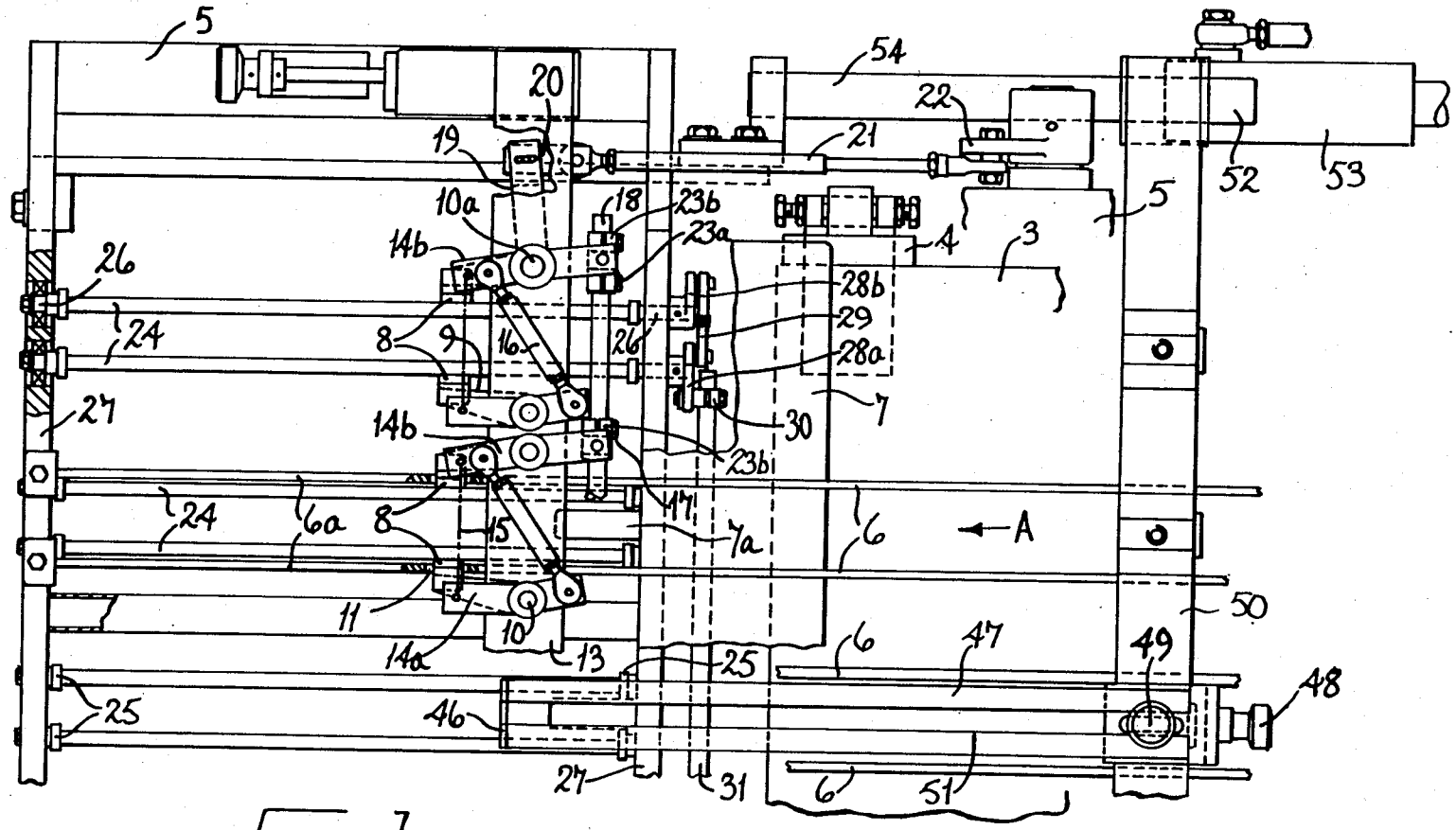
FIG. 1 is a plan view of part of apparatus embodying the invention in which, for greater clarity, clamping devices have been shown in a different position from their actual position, having been translated in toto along supply lines of the apparatus.

The illustrative apparatus provides first of all for the separation into a plurality of groups 1, of articles 2 which are standing on edge and abutting one another, leaning against each other in a kind of horizontal stack with their large faces in contact. The articles 2 are delivered in a direction A, by a plurality of supply lines. The articles 2 shown are flat and round biscuits: however other generally flat objects of different shape may also be handled in apparatus generally similar to the illustrative apparatus.

A conveyor belt 3 of the apparatus is regarded as forming part of the supply lines. The belt 3 advances continuously in the direction A and, at its downstream end passes round a roller 4, supported by framework 5 of the apparatus. Each supply line is defined by a pair of side panels 6 which, in an adjustable manner, known per se, are supported in the illustrative apparatus by the framework 5 immediately above the upper branch of the belt 3 and which constitute a guide for a row of adjacent articles 2, standing on edge. In the case of biscuits, a row of biscuits leaving the cooking oven corresponds to the row of a supply line. In a known manner, the output rows are caused to increase their mutual spacing progressively until the spacing reaches that between the rows of the supply lines and furthermore the biscuits of the output rows are caused to move from a condition in which they are lying flat one behind the other to a condition in which they are more or less vertical and abutting one another. Hence the belt 3 moves slowly. When, however, because of the type of biscuit, the relative movement between the surfaces of the biscuits which are in contact is difficult, such movement is facilitated by using vibrators which vibrate the side panels 6 and the shelves on which the upper branch of belt 3 slides. The supply lines terminate at respective tongue-like projections 7*a* which project from a single plate 7 fixed to the framework 5 and which constitutes a continuation of the upper branch of the conveyor belt 3.

At the end or outlet of each supply line respective clamping devices are arranged, which comprise a pair of braking blocks 8. Each block 8 is attached to an associated arm 9, fixed to the lower end of a vertical pin 10. At the outlet of each supply line the side panels 6 are provided with slots 11, which, as has already been stated, are not shown in their true position in FIG. 1. The respective blocks 8 pass through these slots from the outside, as will be explained below, wherever they are required to close and clamp an article 2*a* which is about to emerge from the associated projection 7*a*. The various pins 10 are mounted for rotation by means of associated bushings, in corresponding sleeves 12 formed in a single profiled section 13; This profiled section extends transversely to the supply lines and its ends are supported by the framework 5 so that its position is adjustable longitudinally relative to the supply lines. To the upper end of the two pins 10 associated with a pair of blocks 8 are fixed a pair of two-arm levers 14*a*, 14*b*, one to each pin 10. A tension spring 15 extends between the arms of the pair of associated levers 14*a*, 14*b*, which are disposed above the associated blocks 8. Between said arm of the lever 14*b* and the other arm of the associated lever 14*a* a tie rod 16 of adjustable length is articulated. To the arm of each lever 14*b* which is remote from the associated block 8, a small block 17 is articulated with play, the block 17 sliding on a rod 18 which is parallel to the profile section 13. A pin 10*a*, next to one end of the profile section 13, has an arm 19 fixed to it, at the bottom, as well as its arm 9.

To the arm 19 a shackle 20 is articulated, with play, which is also articulated to a connecting rod 21 of adjustable length, which is engaged with a control rocker arm 22 supported for oscillating movement by the framework 5. The small block 17 of the lever 14*b* associated with the pin 10*a*, is prevented from sliding in both directions relative to rod 18: it is in fact interposed between a pair of clamps 23*a* and 23*b* clamped to the same rod. The relative movements of the other small blocks 17 are, on the other hand, limited only by associated clamps 23*b*.

As the rocker arm 22 performs an angular stroke in a direction which places the shackle 20 in traction, the lever 14*b* by means of its own small block 17 which acts on clamp 23*a*, causes a displacement of the rod 18 and a consequent action on the other small blocks 17 and on the associated levers 14*b* by the respective clamps 23*b*. The various pairs of levers 14*a-b*. are therefore moved simultaneously against the action of the spring 15 to move the blocks 8 into an open condition. If the rocker arm 22 makes an angular stroke in the opposite direction, the pairs of blocks 8, because of the spring 15, simultaneously close resiliently and in a self-centring way, on articles 2*a* which are between each pair of blocks 8.

Figure 2:
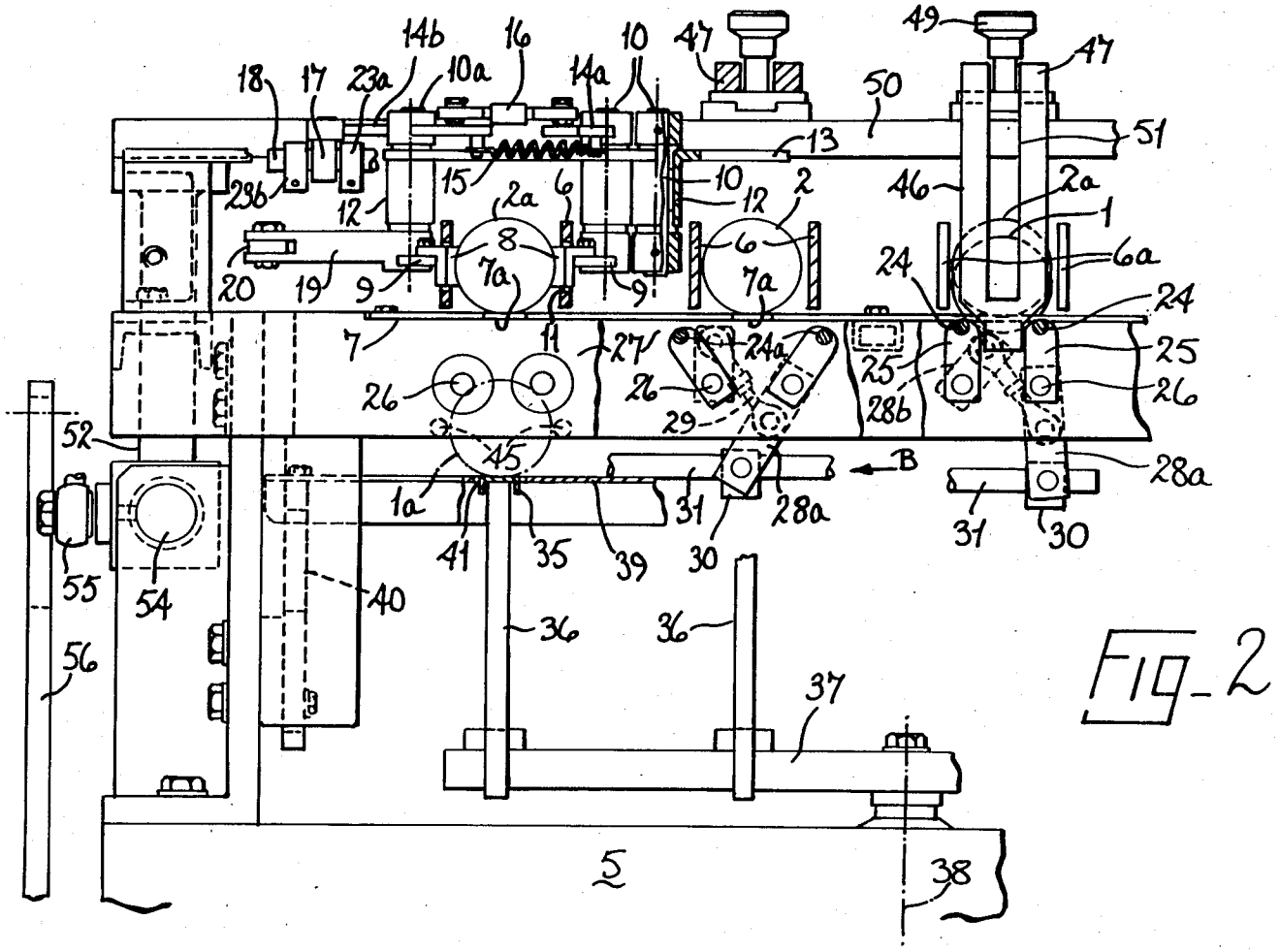
FIG. 2 is a front view of the same part of the apparatus as FIG. 1, showing one set of supports in an active condition and another in a removed condition.

Articles 2 which have emerged from a projection 7*a* are guided between a pair of extensions 6*a* of the respective side panels 6 and are supported instead by associated support elements, namely a pair of horizontal rods 24 which are parallel to the side panels and which support the objects at a slightly lower level than that at which they were disposed when they were still supported by the plate 7. Integral with the ends of each rod 24 are corresponding downward projections 25 which are radial to the rods and are fixed to associated pins 26. The two pins 26 associated with each rod 24 are coaxial and are parallel to the rod. By means of interposed bearings, the pins 26 are mounted for rotation in horizontal bars 27, which are transverse to the supply lines and form part of a frame cantilevered on the framework 5. Arms 28*a*, 28*b* are fixed one to each of the fixed pins 26 which are associated with each pair of rods 24 and are adjacent one of the bars 27. The arms 28*a* face downwards and the arms 28*b* upwards; between the two arms 28*a* and 28*b* a tie bar 29 is then articulated. Arms 28*a* are further articulated, with play, to associated clamps 30, clamped to a single rod 31 parallel to the bars 27; to this rod a further clamp 32 is also clamped, to which is articulated a tie rod 33, articulated to a control rocker arm 34 mounted for oscillating movement on the framework 5. The rocker arm 34 is normally stationary in a position in which the pairs of rods 24 perform their support function, as is shown in the right hand part of FIG. 2. When, however, the rocker arm 34 causes the rod 31 to move in direction B (central part of FIG. 2) the rods 24 of each pair are symmetrically moved apart and slightly lowered, reaching position in which the rods 24*a* are shown; simultaneously, the pairs of rods release the groups 1 of articles formed thereon as will be explained below, on to associated carriers 35 which are rapidly raised to their top position, immediately beneath the rods.

Each carrier 35 is tile shaped, elongated parallel to the rods 24 and is integral with the top of an associated bracket 36; at their lower ends the various brackets 36 are fixed in an adjustable manner to a single bar 37 parallel to the bars 27. The bar 37 is fixed to the top of a pair of vertical control rods, which are mounted for reciprocatory movement in the framework 5; in FIGS. 2 and 3 an axis 38 of one of such rods is shown. Normally these vertical control rods are stationary at the lowermost end of their stroke as a result of which the carriers 35 are halted in their lowest position, shown in FIGS. 2 and 3. In this position the carriers are at the same level as a shelf 39, carried by supports which are fixed in an adjustable manner to elements of the housing of the bars 27; the shelf 39 has slots 41 corresponding to the carriers 35. The shelf lies below the upper branch of a conveyor which defines a receiving line for the groups of articles already formed on the pairs of rods 24. At the receiving line, these groups, previously indicated by 1, are indicated by 1*a*. This conveyor is of a type constituted by a pair of chains 42, a lower branch of which is supported by respective rails 43, and the upper branch of which is engaged by guides 44, the rails 43 and the guides being parallel to the bars 27 and being fixed to the frame housing the bars 27. Between the chains 42 pairs of small rods 45 of rounded section extend transversely, regularly distributed along said chains.

Along said conveyor, housings intended for groups 1*a* are then defined, at intervals, a housing for a group of objects being delimited between an associated pair of the small rods 45. The pair of chains 42 pass round a pair of driving wheels and a pair of driven wheels, not shown. Whilst the carriers 35 complete their upward stroke and subsequent downward stroke, the chains 42 are momentarily stationary and the housings defined by the pairs of small rods 45 of the upper branch of the conveyor are in register with the slots 41 so that they may be intersected by the carriers both during their upward and downward movement. During their downward stroke the carriers 35, which have received the groups of articles from the pairs of rods 24 which have moved apart, release the groups into the corresponding housings. The chains 42 move intermittently by one housing at a time, and, between the release of one set of groups 1 by the rods 24 and the release of the next subsequent set, advance by as many of the housings between the rods 45 as there are supply lines. The time which then elapses between such two successive releases, is wholly adequate for the formation of groups 1. In fact the devices which, as will be explained, control this formation can operate with the necessary slowness and delicacy required for fragile articles. Groups 1*a*, which the upper branch of the conveyor causes to slide on the shelf 39, are also guided between a pair of side panels (not shown) which are mounted inwardly of the guides 44. Groups 1*a* are thus supplied, one after the other, for subsequent processing, for example by a machine which wraps and/or packages them.

There are no difficulties in equipping the machines involved with devices which sense the presence of groups 1*a*. Consequently, if for any reason some housings on the conveyor arrive at the subsequent machine without the groups of articles such sensing devices would ensure that during these cycles the machine would operate empty without any drawbacks. It is irrelevant whether such a machine is placed at one or at the other end of the conveyor provided that the upper branch is arranged to extend and travel towards it in passing the outlets of the various supply lines.

Figure 3:
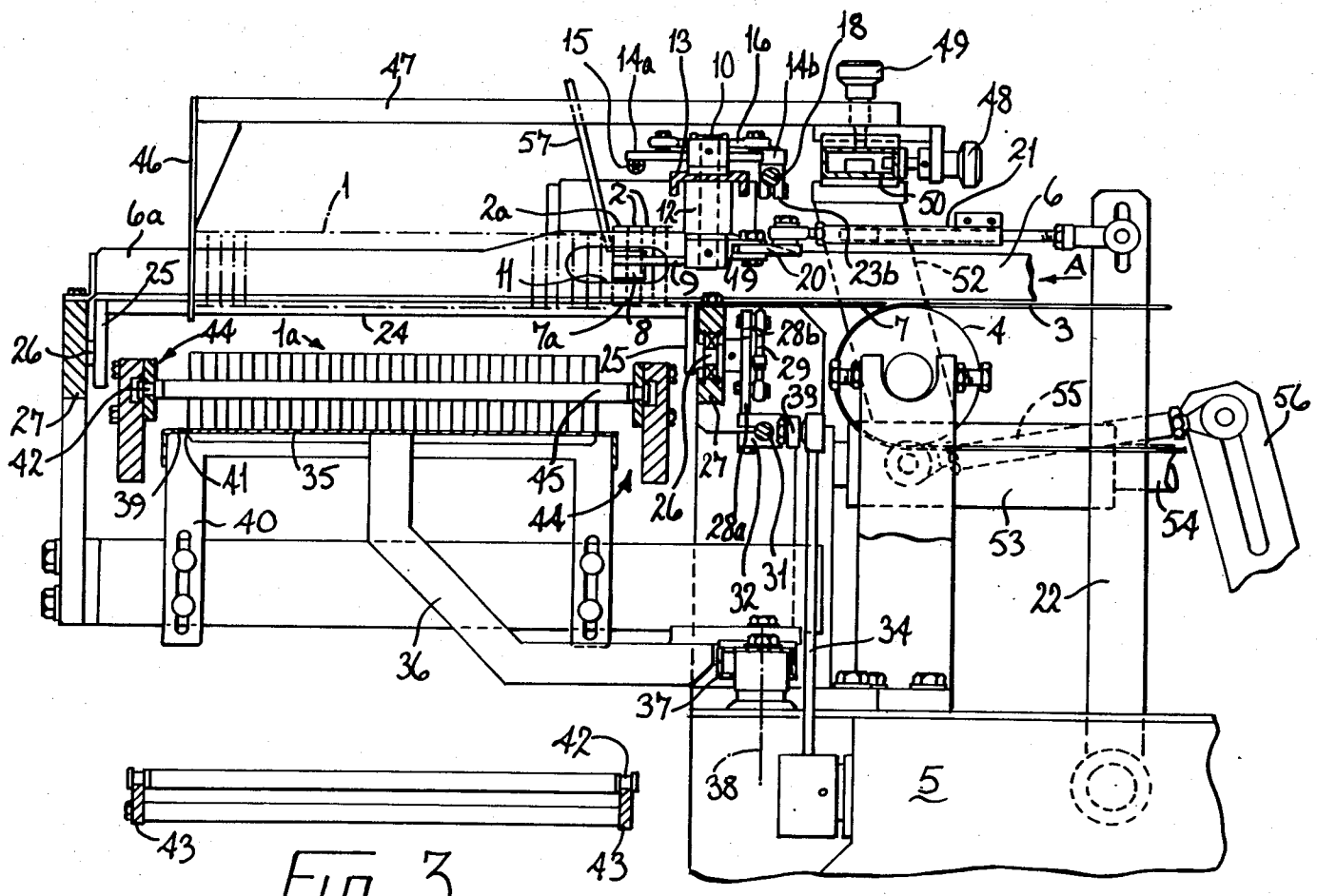
FIG. 3 is a vertical cross-section of the apparatus showing the clamping devices in their actual positions.

Dealing now with the method of formation of the groups 1, it can be seen that, for each supply line, there is a vertical, laminar front face 46, which reciprocates horizontally and longitudinally with respect to this line, between the appropriate pair of side panels 6*a*. Each face 46 is mounted at one end of an associated long horizontal arm 47, of which the other end, by means of a screw 48, is micrometrically positionable, and by means of a screw 49 is lockable in relation to a beam 50. Together, the face 46 and the arm 47 assume a configuration similar to a fork bent at right angles, both being divided in two by a median passage 51. The ends of the beam 50 (which beam is common to all the arms 47 and transverse to the supply lines) are fixed on respective legs 52 which, at the bottom, are integral with associated sleeves 53. The sleeves 53 are slidable along rods 54 which are integral with the framework 5 and which, like the arms 47, are parallel to the supply lines. Respective connecting rods 55 of adjustable length, are articulated to the sleeves 53, and the rods also engage related control rocker arms 56, supported for oscillating movement by the framework 5. Whilst the beam 50, which remains, however, upstream of the profiled section 13 is moved towards the section 13, the faces 46 are moved simultaneously away from the associated tongues 7*a* or from the outlets of the respective supply lines towards a final, remote position which, as shown in FIG. 3, is spaced from said outlets by slightly more than the length set for the groups 1 of articles 2. Similarly as the faces move away from the outlet the blocks 8 are open and, if there is a sufficient number or load of articles 2 upstream of the outlets, these emerge from the tongues 7*a* and follow the faces 46 remaining leaning against them. At the ends of the tongues 7*a* a difference in level between the articles which have emerged and those remaining on the plate 7 exists, due to the support at different levels provided by the plate 7 and by the rods 24. Shortly before the faces 46 reach their final remote position, they stop very briefly at which point the blocks 8 close. The faces 46 thus reach their end of stroke when the flow of articles from the supply lines has been interrupted and the articles of the group 1, now formed, are slowed down. In the meantime upstream of each group 1 a sort of sprung finger 57 is lowered which causes a clear separation between the last article which has emerged or is emerging from the respective tongue 7*a* and forms part of the group 1, and the article 2*a*, which, on the other hand, is clamped by the blocks 8. The fingers 57 descend through the passage 51 of the respective arms 47.

Figure 4:
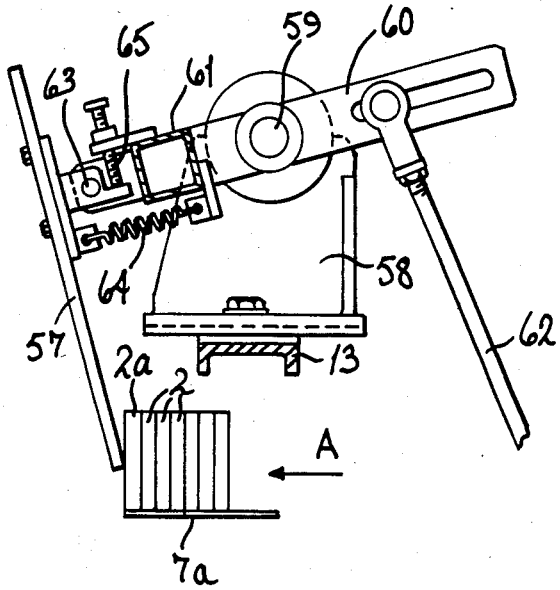
FIG. 4 is a view similar to FIG. 3 but showing a sprung finger of the illustrative apparatus in greater detail.

The fingers 57 remain in contact with the articles 2*a* until the point at which the pairs of rods 24 have released the groups 1, and the faces 46 have returned to the outlets of the supply lines and, upon the reopening of the blocks 8, themselves come into contact with the articles 2*a*. The fingers 57 then rise again to allow articles 2 to flow again from the supply lines and the formation of further groups 1 again takes place. As far as fingers 57 are concerned it can be seen (FIG. 4) that respective supports 58 are mounted in an adjustable manner on the ends of the profile section 13. On each of the supports 58 a two-armed lever 60 is mounted for oscillating movements on pivots 59. Those arms of the two levers 60 which face downstream are connected to each other by a horizontal rod 61, whilst the arms facing upstream are engaged by respective connecting rods 62. The connecting rods 62 are of adjustable length and are also engaged by control rocker arms (not shown). At each supply line, an upper part of an asscciated finger 57 is mounted for pivotal movement on a pivot 63 carried by front projections of the rod 61. A tension spring 64 which extends between the finger, a little below the pivot 63, and the back of the rod 61, urges the finger towards an abutment 65, adjustably mounted on said rod.

Sensing devices, disposed along the conveyor belt 3, detect the supply of articles along the supply lines or, rather, the variation in the load of these adjacent the outlets of the lines. Depending on such detection the operating cycle of a machine disposed downstream of the receiving line, 42–45, is automatically made slower or faster. An output shaft of this machine drives the various movable elements of the illustrative apparatus, e.g. through the various control rocker arms: consequently the movable elements of the illustrative apparatus slow down or accelerate their cycle, in unison with the cycle of this machine.

The illustrative apparatus operates with precision and handles the articles carefully even if their thickness varies. The illustrative apparatus is designed to provide flexibility with respect to the number of supply lines existing and actually in use and with respect to the throughput of the lines. The illustrative apparatus is also relatively simple, reliable and compact, and of adequate speed.

Having thus described my invention and the manner in which it is to be performed, what I claim as new and desire to secure by Letters Patent of the United States is:

1. Apparatus for separating articles leaning against one another and standing on edge, and supplied by a plurality of supply lines, each supply line having an outlet and forming a group to be deposited to a conveyor downstream and below from said supply lines, the apparatus comprising: a plurality of opening and closing clamping devices operating simultaneously to clamp the articles at the respective outlets, each clamping device disposed at the respective outlet to retain the articles at said respective outlet; a plurality of movable suport elements, each support element disposed as a continuation of the respective supply line at a lower level than the respective outlet, said support elements arranged to be simultaneously moved to release the respective groups of articles to a plurality of carriers; a plurality of faces mounted for simultaneous reciprocating movement, each face reciprocating between the respective outlet and a remote end position, which is spaced from said respective outlet by a distance which is slightly greater than the length of each individual group of articles, said each face arranged to reciprocate after the closure of the respective clamping device, and upon the returning of said face to said outlet, said respective clamping device is opened; said plurality of carriers movable simultaneously, each carrier movable between a raised position, immediately beneath the respective support element and above said conveyor, and a lowered position beneath said conveyor, said each carrier being arranged, in the raised position, to receive the respective group of articles released by said respective support element and to deposit said respective group of articles onto said conveyor, which said each carrier intersects; said conveyor being arranged to be stationary during said movement of said carriers, and said conveyor being arranged to move the groups of articles when said carriers are in said lowered position in a direction transverse to said supply lines, and between the deposit of one set of groups of articles to said conveyor and the deposit of a subsequent set, said conveyor being arranged to advance by as many steps as there are supply lines, in said transverse direction.

2. Apparatus according to claim 1, further comprising a plurality of simultaneously movable sprung fingers, each finger in register with, the outlet and which, on the closure of said clamping device, is arranged to act on the end of the group of articles opposite the face in such a way as to cause, as the respective movable face reach the end position, a clear separation between the last article of each of the groups and the first corresponding article clamped by the clamping device, said each finger being furthermore arranged to remain in contact with said first article thus temporarily clamped until, on reopening of the clamping device, the movable face returns to said outlet and themself provides the contact with said first article.

3. Apparatus according to claim 1 wherein said each support element is constituted by pair of rods which are supported for pivotal movement and which, by moving apart symmetrically are arranged to be moved to release the group of articles onto the carrier in their raised position.

4. Apparatus according to claim 1 wherein said clamping devices close simultaneously in conjunction with a very brief stop of the movable faces a little before reaching their said end position.

5. Apparatus according to claim 1 wherein said each clamping device is constituted by a pair of brake blocks arranged to close in a self-centering manner on the articles by resilient means and means are provided positively to open said device.

6. Apparatus according to claim 1 wherein said conveyor comprises an upper branch which are provided, at intervals, spaces to accommodate the groups of articles.

7. Apparatus according to claim 6 wherein said conveyor is a chain-type conveyor and the spaces are formed between pairs of rods extending transversely between the chains, the upper branch overlying a shelf which provides support for and guides and the goups and which has passing through it a plurality of slots, each slot being in register with the respective carrier, the carriers in their lowered position are coplanar to the shelf.

8. Apparatus according to claim 2 wherein the movable faces are mounted on associated arms cantilevered from a common beam, movable in an adjustable reciprocating manner, the arms being individually adjustable, in relation to said beam and the faces and each arm being divided into two parts to define a passage for the associated sprung finger.

* * * * *